US005937952A

United States Patent [19]

Bigoney

[11] Patent Number: 5,937,952

[45] Date of Patent: Aug. 17, 1999

[54] FEED SHELL POSITIONING MECHANISM

[75] Inventor: Paul R. Bigoney, Newport, N.H.

[73] Assignee: Cannon Industries, Inc., Claremont, N.H.

[21] Appl. No.: 09/001,752

[22] Filed: Dec. 31, 1997

[51] Int. Cl.[6] ..... B25B 13/50

[52] U.S. Cl. ..... 173/190; 173/44; 173/193

[58] Field of Search ..... 173/193, 194, 173/195, 190, 44, 45, 1, 192, 39, 42

[56] References Cited

U.S. PATENT DOCUMENTS

| | | | |
|---|---|---|---|
| 3,212,738 | 10/1965 | Curtis et al. | 248/16 |
| 3,246,705 | 4/1966 | Chappuis | 173/44 |
| 3,304,033 | 2/1967 | Thompson | 173/195 |
| 3,493,200 | 2/1970 | Huffman | 173/193 |
| 3,565,184 | 2/1971 | Gustafsson | 173/193 |
| 3,868,076 | 2/1975 | Beagan | 173/193 |
| 4,351,625 | 9/1982 | Selestam et al. | 405/303 |
| 4,398,850 | 8/1983 | Talvensaari | 173/193 |
| 4,799,556 | 1/1989 | Foster | 173/193 |
| 5,016,942 | 5/1991 | Spross et al. | 299/33 |
| 5,383,524 | 1/1995 | Rinnemaa | 173/190 |

*Primary Examiner*—Scott A. Smith
*Assistant Examiner*—James P. Calve
*Attorney, Agent, or Firm*—Michael J. Weins; Jeffrey E. Semprebon

[57] ABSTRACT

An improved feed shell positioning mechanism for a rock drilling machine, having a boom, a feed shell support pivotably mounted with respect to the boom and supporting a feed shell having a feed shell axis, a roll actuator interposed between the boom and the feed shell support, and a rock drill having a rock drill axis. The rock drill axis and the feed shell axis are parallel and define a reference plane. The improvement resides in a swivel assembly for attaching the feed shell support to the roll actuator, allowing the feed shell support to swivel between a forward drilling orientation and a sideways drilling orientation. The swivel assembly has a roll actuator securing element, mounted to the roll actuator, and a feed shell support securing element, mounted to the feed shell support, which are pivotably mounted to each other about a swivel pivot axis which is inclined with respect to the reference plane. With the swivel pivot axis so inclined, the drill axis is moved into closer proximity to the roll actuator axis when pivoted to the sideways drilling orientation, providing a reduced moment arm for forces generated by the rock drill.

16 Claims, 13 Drawing Sheets

FEED SHELL POSITIONING MECHANISM

FIELD OF THE INVENTION

The present invention relates to an improved feed shell mounting mechanism and more particularly for a positioning mechanism for a feed shell mounted to a boom assembly of a rock drilling machine.

BACKGROUND OF THE INVENTION

In mining operations, holes are frequently drilled into the walls, floor, and/or roof of the mine passages to plant explosives to fracture the rock. Holes are also drilled for setting bolts to stabilize the rock surfaces of the mine passages. A rock drilling machine such as a rock drill jumbo or a roof bolter is usually employed for such drilling operations.

The rock drilling machine typically has a feed shell positioning mechanism which includes a boom which is attached to a carrier vehicle which is used to mobilize the boom. One example of such a boom and carrier vehicle is shown in U.S. Pat. No. 5,556,235, assigned to the assignee of the present application. FIGS. 1 through 5 illustrate exemplary prior art feed shell positioning mechanisms.

FIGS. 1 and 2 illustrate respectively a side view and an end view of a prior art feed shell positioning mechanism 10 which is mounted to a boom 12. The boom 12 is attached to a carrier vehicle (not shown) which serves to transport the feed shell positioning mechanism 10 to the rock surface. A feed shell support 14 is pivotably and rotatably mounted with respect to the boom 12. A feed shell 16, having a longitudinal feed shell axis 18, slidably engages the feed shell support 14. A feed shell advancing actuator 20 is employed as a means for advancing the feed shell 16 toward a rock surface to be drilled.

The boom 12 usually has attached thereto a horizontal wrist joint 22 and a vertical wrist joint 24. The wrist joints (22 and 24) permit the feed shell 16 to be tilted relative to the boom 12. The wrist joints (22 and 24) permit adjustment of the feed shell 16 with respect to the boom 12 so that a series of parallel holes can be drilled as the boom 12 is moved. It should be noted that any pair of wrist joints or a universal joint which acts in substantially normal planes could be employed to allow drilling parallel holes as the boom 12 is moved; however, having both a horizontal and a vertical wrist joint simplifies the description of the geometry, and such a configuration will be used for describing embodiments discussed in the application.

To provide further flexibility in the positioning of the feed shell 16, the feed shell positioning mechanism 10 includes a roll actuator 26 having a roll actuator axis 28. The roll actuator 26 is connected to the boom 12, having the wrist joints (22 and 24) interposed therebetween. The roll actuator 26 provides a means of rotation about the roll actuator axis 28 and increases the adjustability of the feed shell 16. A variety of rotary actuators are commercially available such as Helac® helical rotary actuators. Helical rotary actuators are further described in U.S. Pat. No. 4,422,366.

Helical rotary actuators provide a large angular displacement between a radially internal output shaft, which in the roll actuator 26 illustrated is affixed to the boom 12, and a housing, which is rotated about the roll actuator axis 28.

The feed shell positioning mechanism 10 also has a rock drill 30, which is advancable along the feed shell 16. The rock drill 30 has a drill axis 32, which is parallel to the feed shell axis 18. The feed shell axis 18 and the drill axis 32 define a reference plane 34.

A swivel assembly 36 is interposed between the roll actuator 26 and the feed shell support 14. The swivel assembly 36 has a roll actuator securing element 38 attached to the roll actuator 26. A feed shell support securing element 40 is attached to the feed shell support 14. The feed shell support securing element 40 pivots relative to the roll actuator securing element 38 about a swivel axis 42. The swivel axis 42, for the positioning mechanism illustrated, is parallel to the reference plane 34, as can be best seen in FIG. 2.

The swivel assembly 36 also includes a swivel activation means for pivoting the roll actuator securing element 38 with respect to the feed shell support securing element 40. The swivel activation means serves to pivot the feed shell support 14 about the swivel axis 42 to move the feed shell 16 and the rock drill 30 between a forward drilling orientation, illustrated in FIGS. 1 and 2, and a sideways drilling orientation, illustrated in FIGS. 3 and 4. In the feed shell positioning mechanism 10 illustrated in FIGS. 1 through 4, the swivel activation means is provided by a hydraulic cylinder 44 which is pivotably mounted to the roll actuator securing element 38 and is also pivotably mounted to the feed shell support securing element 40.

In the forward drilling orientation, the feed shell axis 18 is substantially parallel to the roll actuator axis 28. In the sideways drilling orientation, the feed shell axis 18 is substantially normal to the roll actuator axis 28. It will be noted that, when the roll actuator 26 is positioned such that the feed shell 16 is co-planar with the boom 12 in a vertical plane and the roll actuator axis 28 is in a horizontal plane, the feed shell axis 18 remains horizontal as the feed shell support 14 is swivelled between the forward drilling orientation and the sideways drilling orientation.

FIG. 5 illustrates an alternative prior art feed shell positioning mechanism 10', which employs a swivel assembly 36' where the swivel axis 42' is perpendicular to the reference plane 34'. In the feed shell positioning mechanism 10', the boom 12 does not reside in the reference plane 34' when the feed shell 16 is in the forward drilling orientation, as occurs with the feed shell positioning mechanism 10 illustrated in FIGS. 1 through 4. Rather, the boom 12 is offset from the reference plane 34' to avoid interference. In the feed shell positioning mechanism 10', the feed shell 16 pivots such that the feed shell axis 18 is roughly vertical when the feed shell 16 is swivelled into the sideways drilling orientation, as is shown in phantom.

The offset of the boom 12 with respect to the reference plane 34 when the feed shell 16 is in the forward drilling orientation avoids interference between the feed shell 16 and the boom 12 as the vertical wrist joint 24 is used to tilt the feed shell 16 relative to the boom 12.

However, having the boom 12 offset with respect to the reference plane 34 when the feed shell 16 is positioned in the forward drilling orientation is generally undesirable, since it makes positioning the rock drill 30 difficult in corners. In corners, interference of the boom 12 with a sidewall may prevent positioning the rock drill 30 in locations in close proximity to the sidewall. This typically requires the roll actuator 26 to be used to rotate the feed shell 16 to the side of the boom 12 near the sidewall, which interrupts work while the feed shell 16 is repositioned, and also results in the feed shell 16 and rock drill 30 being inverted, which interferes with visibility for the operator.

To avoid the problems which result from offsetting the feed shell 16, it is generally preferred to center the feed shell 16 over the boom 12, such that the boom 12 resides in the reference plane 34 when the feed shell 16 is in the forward drilling orientation, as is the case with the feed shell positioning mechanism 10 illustrated in FIGS. 1 through 4. When the feed shell 16 is so positioned, it is desirable to have a large separation between the feed shell axis 18 and the roll actuator axis 28. This large separation allows the vertical wrist joint 24 to tilt the feed shell 16 relative to the boom 12 in the reference plane 34 over a fairly large range without the feed shell 16 interfering with the boom 12. Similarly, if the roll actuator 26 is activated to position the feed shell,16 alongside the boom 12, the large separation allows the horizontal wrist joint 22 to angle the feed shell 16 relative to the boom 12 in a horizontal plane without interference.

Positioning the feed shell 16 over the boom 12 and providing a large separation S between the drill axis 32 and the roll actuator axis 28 is desirable for forward drilling, since it provides a large separation between the boom 12 and the feed shell 16. However, a large separation S between the drill axis 32 and the roll actuator axis 28 is undesirable when the feed shell 16 is pivoted from the forward drilling orientation to the sideways drilling orientation. In the sideways drilling orientation, when the separation S between the drill axis 32 and the roll actuator axis 28 is large, the large separation S results in undesirably large torsional loads on the boom 12, the roll actuator 26, and the swivel assembly 36.

Thus, there is a need for a feed shell positioning mechanism which has the feed shell centered with respect to the boom and where there is a small separation between the drill axis and the roll actuator axis when in the sideways drilling orientation, while still maintaining a large separation between the feed shell and the boom in the forward drilling orientation.

SUMMARY OF THE INVENTION

The present invention provides an improved feed shell positioning mechanism for a rock drilling machine. The improved feed shell positioning mechanism has a boom, which is frequently attached to a carrier vehicle used to transport the feed shell positioning mechanism to a rock surface which is to be drilled. A feed shell support is pivotably and rotatably mounted with respect to the boom. A feed shell having a feed shell axis slidably engages the feed shell support, and a means for advancing the feed shell along the feed shell support is provided.

A roll actuator having a roll actuator axis is interposed between the boom and the feed shell support, providing rotational motion between the feed shell support and the boom about the roll actuator axis.

A rock drill is provided which is advancable on the feed shell. The rock drill has a rock drill axis which is parallel to the feed shell axis and which, in combination with the feed shell axis, defines a reference plane.

It is preferred to provide a means for maintaining the rock drill horizontal as the boom is raised or lowered when the rock drill is positioned in a forward drilling position. One particularly useful means for maintaining the rock drill horizontal is a vertical wrist joint positioned between the boom and the roll actuator. Similarly, it is preferred to provide a horizontal wrist joint to provide a means for maintaining the rock drill aligned with respect to a vertical plane as the boom is moved horizontally.

The improvement of the present invention resides in a swivel assembly for attaching the feed shell support to the roll actuator, which provides a variable separation between the drill axis and the roll actuator axis.

The swivel assembly, in an elementary form, has a roll actuator securing element which is fixably positioned with respect to the roll actuator, and a feed shell support securing element which is fixably positioned with respect to the feed shell support. The roll actuator securing element and the feed shell support securing element are mounted with respect to each other about a swivel axis which is inclined with respect to the reference plane, providing a pivotal motion between the roll actuator and the feed shell support.

Swivel activating means for pivoting the feed shell support with respect to the roll actuator are provided. The swivel activating means serve to pivot the feed shell support between a forward drilling orientation, where the feed shell axis and drill axis are substantially parallel to the roll actuator axis, and a sideways drilling orientation, where the feed shell axis and drill axis are substantially normal to the forward drilling orientation.

In one preferred embodiment, where the feed shell support securing element is pivotably mounted with respect to the roll actuator securing element, the swivel activating means are provided by a linear actuator pivotably mounted with respect to the roll actuator and the feed shell support.

It is preferred that the angle of inclination of the swivel axis be restricted such that the swivel axis is defined with respect to one of four equivalent pyramids, each having a rectangular base. The swivel axis is parallel to a ray which passes through an apex of one of the pyramids, the apex being spaced apart from the rectangular base of the pyramid through which the ray also passes. The apex of each of the pyramids is a common vertex of the pyramids. The rectangular base of each of the pyramids has a pair of long base sides which form bases for a first pair of isosceles triangular sides of the pyramid which are inclined to each other by an angle of 30° and meet at the apex. Each of the rectangular bases also has a pair of short base sides which form bases for a second pair of isosceles triangular sides of the pyramid which are inclined to each other by an angle of 60° and meet at the apex. Each of the equivalent pyramids is situated such that its respective rectangular base is positioned at a 45° angle with respect to the reference plane, with the pair of long base sides being parallel to the reference plane.

When the swivel pivot axis is inclined with respect to a plane normal to the reference plane, the swivel assembly must be rotated beyond 90° to bring the feed shell support to a sideways drilling orientation where the feed shell axis and drill axis are normal to the roll actuator axis. Such movement may make operation of the feed shell positioning mechanism more difficult for the operator. Thus, it is further preferred that the swivel pivot axis be maintained substantially normal with respect to the reference plane.

In another preferred embodiment, a swivel rotary actuator, having a housing and an output shaft which rotate relative to each other about a common axis, is interposed between and connected to the roll actuator securing element and the feed shell support securing element. The swivel rotary actuator provides the swivel activating means. It is further preferred, when a swivel rotary actuator is interposed between the roll actuator securing element and the feed shell support securing element, that the housing be attached to the roll actuator securing element and the output shaft be attached to the feed shell support securing element.

In all embodiments of the present invention, since the swivel axis is inclined with respect to the reference plane, the motion of the feed shell support, the feed shell, and the rock drill as they are pivoted from the forward drilling orientation to the sideways drilling orientation is significantly different from that of the prior art feed shell positioning mechanism. The feed shell support moves from a horizontal forward orientation to a substantially inclined sideways orientation. In the inclined sideways orientation, the roll actuator must be activated to bring the feed shell support back to a roughly horizontal sideways orientation.

Although it makes positioning the feed shell and the drill in the sideways orientation somewhat more complicated, having the swivel axis inclined with respect to the reference plane provides a significant advantage for drilling in the sideways drilling orientation. With the swivel axis so inclined, both the feed shell axis and the drill axis are moved into closer proximity to the roll actuator axis when the feed shell support is pivoted from the forward drilling orientation to the sideways drilling orientation. This provides a large separation between the feed shell and the boom when the feed shell is in the forward drilling orientation, thereby allowing for tilting the feed shell with respect to the boom, while allowing a relatively small moment arm for the rock drill in the sideways drilling orientation. This smaller moment arm in the sideways drilling orientation results in correspondingly smaller torques on the boom, allowing it to be more compactly and inexpensively constructed. With the swivel axis inclined, the advantageous reduction in the separation between the drill axis and the roll actuator axis in the sideways drilling orientation is achieved without offsetting the reference plane with respect to the boom.

BRIEF DESCRIPTION OF THE FIGURES

FIG. 5 also shows in phantom a vertical sideways drilling position, where the feed shell axis and drill axis are substantially normal to the roll actuator axis.

FIG. 12 also shows rays which represent the inclinations of the swivel axes of the three embodiments discussed in detail.

FIG. 14 also shows, in phantom, where the feed shell support has been rotated about the swivel axis to a sideways drilling orientation, where it is substantially normal to the roll actuator axis.

BEST MODE FOR CARRYING THE INVENTION INTO PRACTICE

Figure 1:
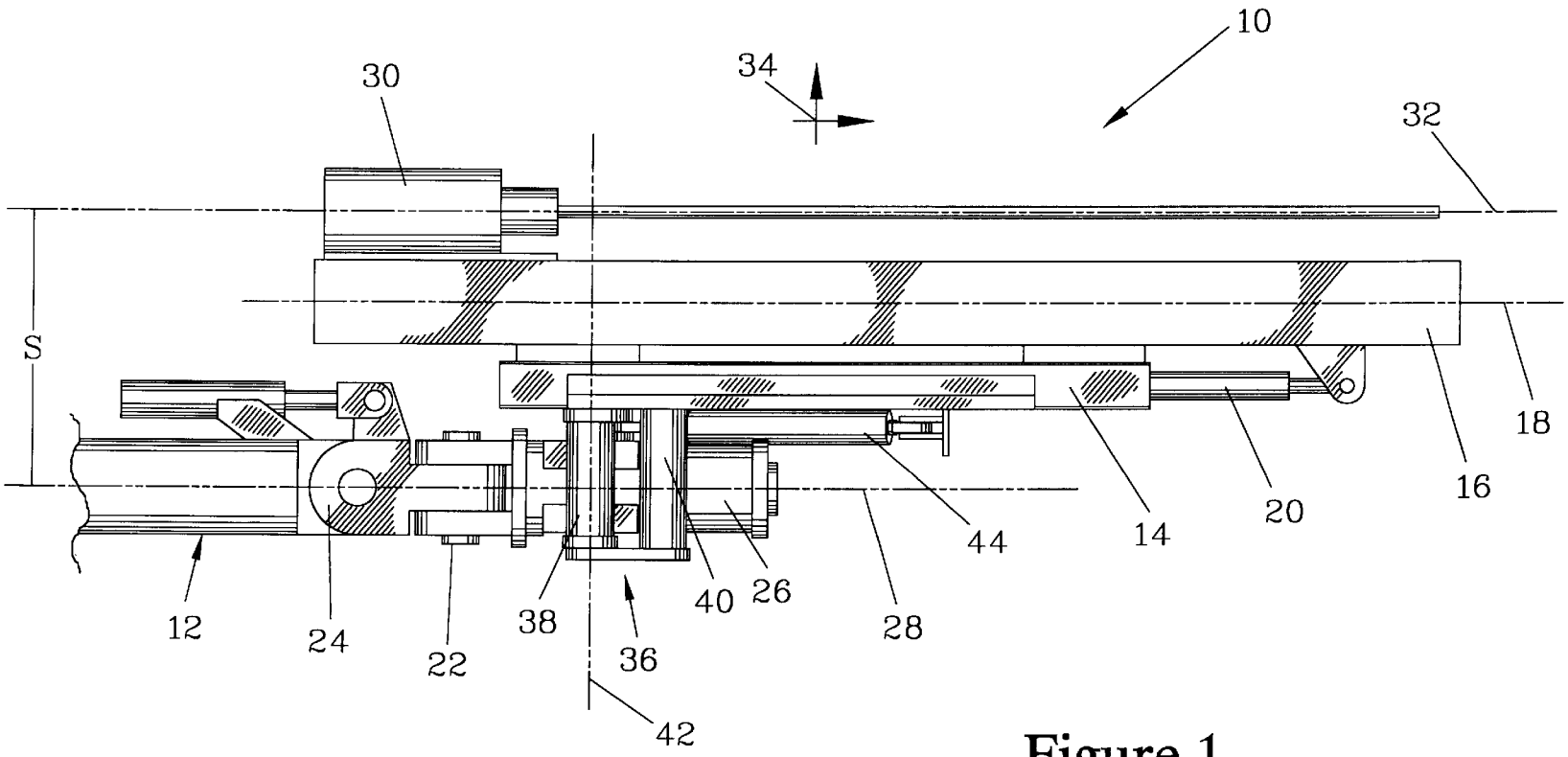
Figure 1 Prior Art
FIG. 1 is a side view of a prior art feed shell positioning mechanism which has a boom, a feed shell support, a feed shell having a feed shell axis, a roll actuator which rotates about a roll actuator axis, and a rock drill having a drill axis. The feed shell axis and the drill axis define a reference plane. A feed shell positioning mechanism is provided which has a swivel assembly connected between the roll actuator and the feed shell support. The swivel assembly has a swivel axis which is parallel to the reference plane defined by the feed shell axis and the drill axis. The feed shell support is shown in a forward drilling orientation where the feed shell axis and drill axis are substantially parallel to the roll actuator axis, and the feed shell axis is substantially horizontal.
Figure 2:
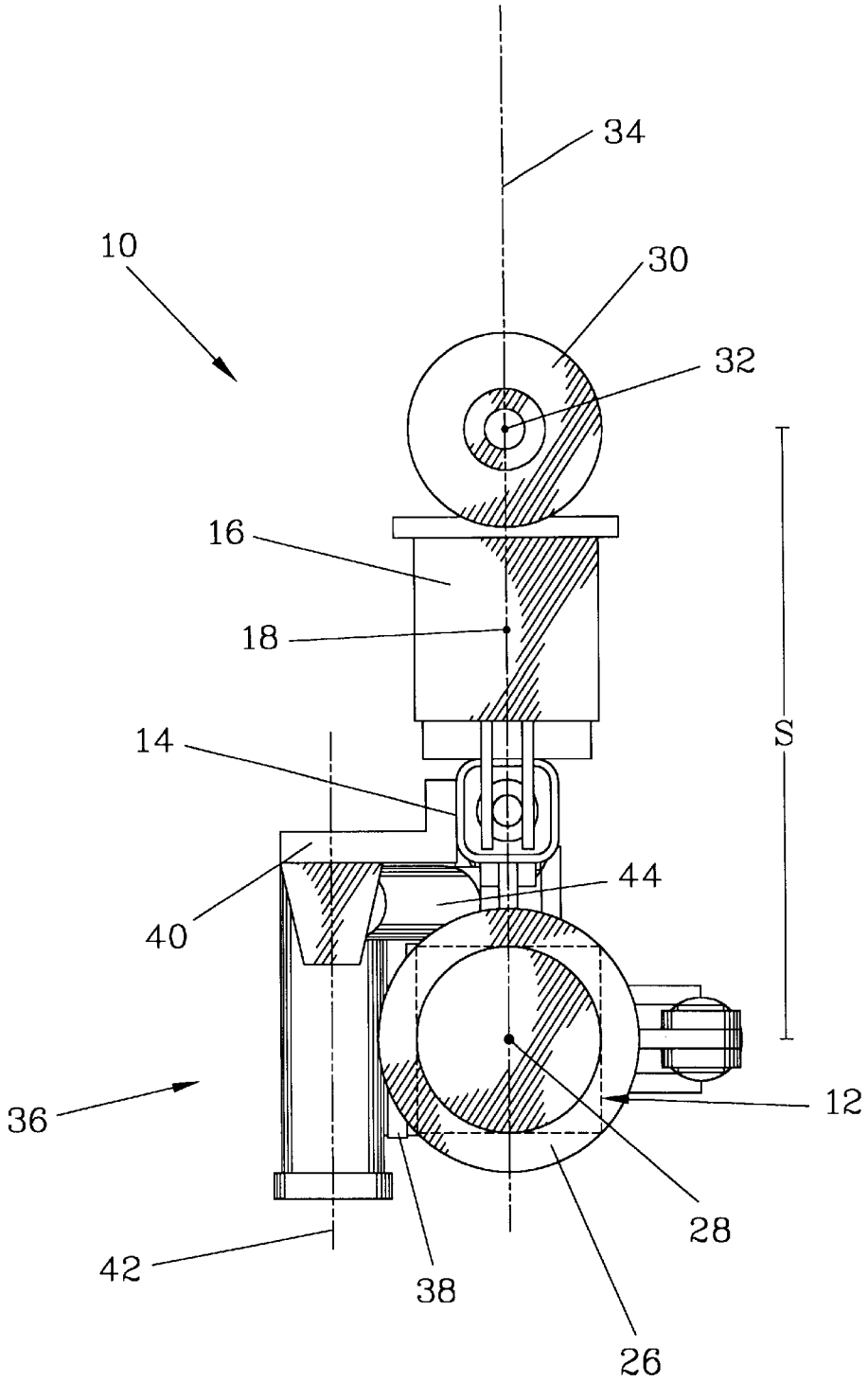
Prior Art Figure 2
FIG. 2 is an end view of the prior art feed shell positioning mechanism shown in FIG. 1.
Figure 3:
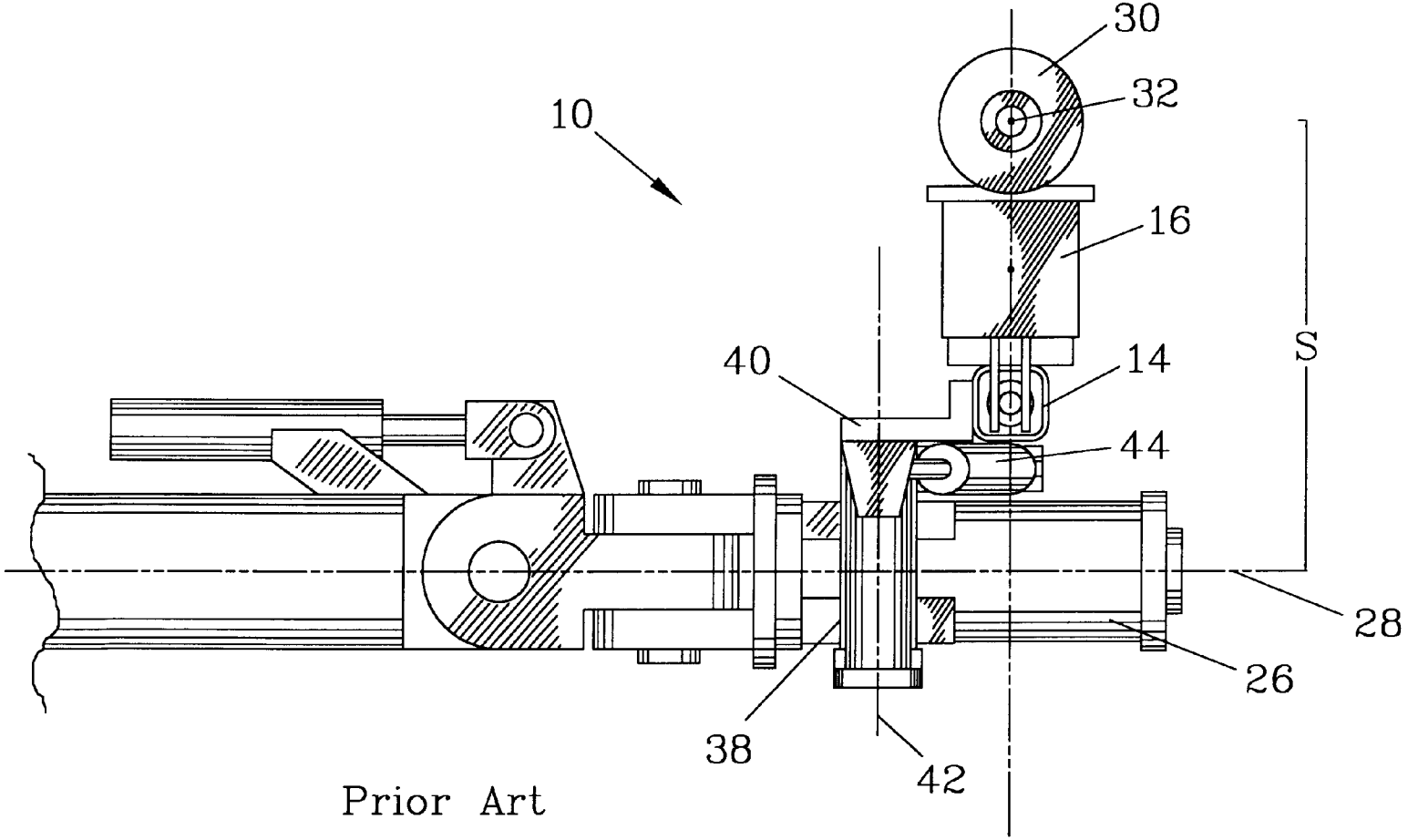
Figure 3 Prior Art
FIG. 3 is a side view of the prior art feed shell positioning mechanism shown in FIG. 1, where the swivel assembly has been activated to pivot the feed shell support to a sideways drilling orientation, where the feed shell axis and drill axis are substantially normal to the roll actuator axis. The feed shell remains substantially horizontal.
Figure 4:
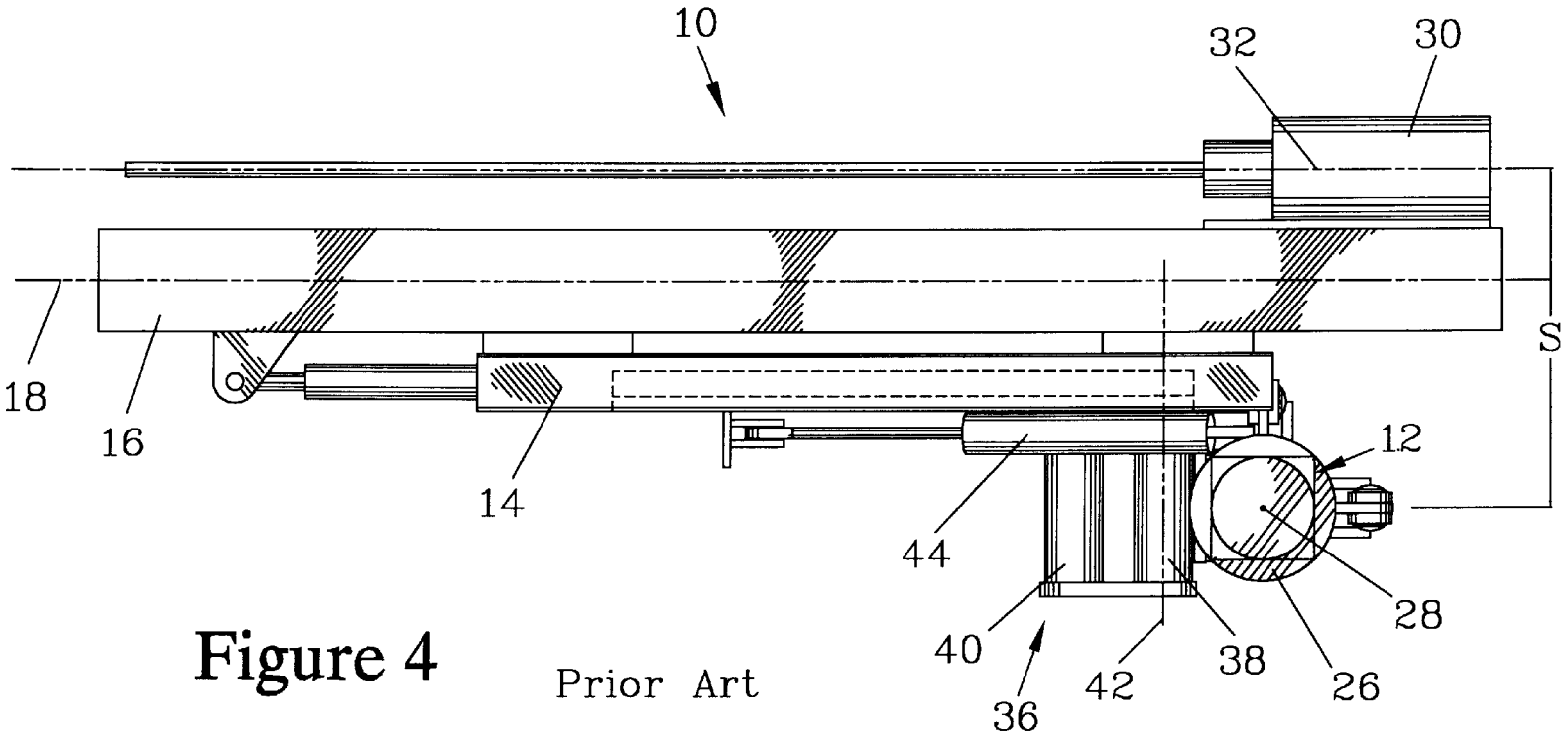
Prior Art Figure 4
FIG. 4 is an end view of the prior art feed shell positioning mechanism shown in FIG. 3.
Figure 5:
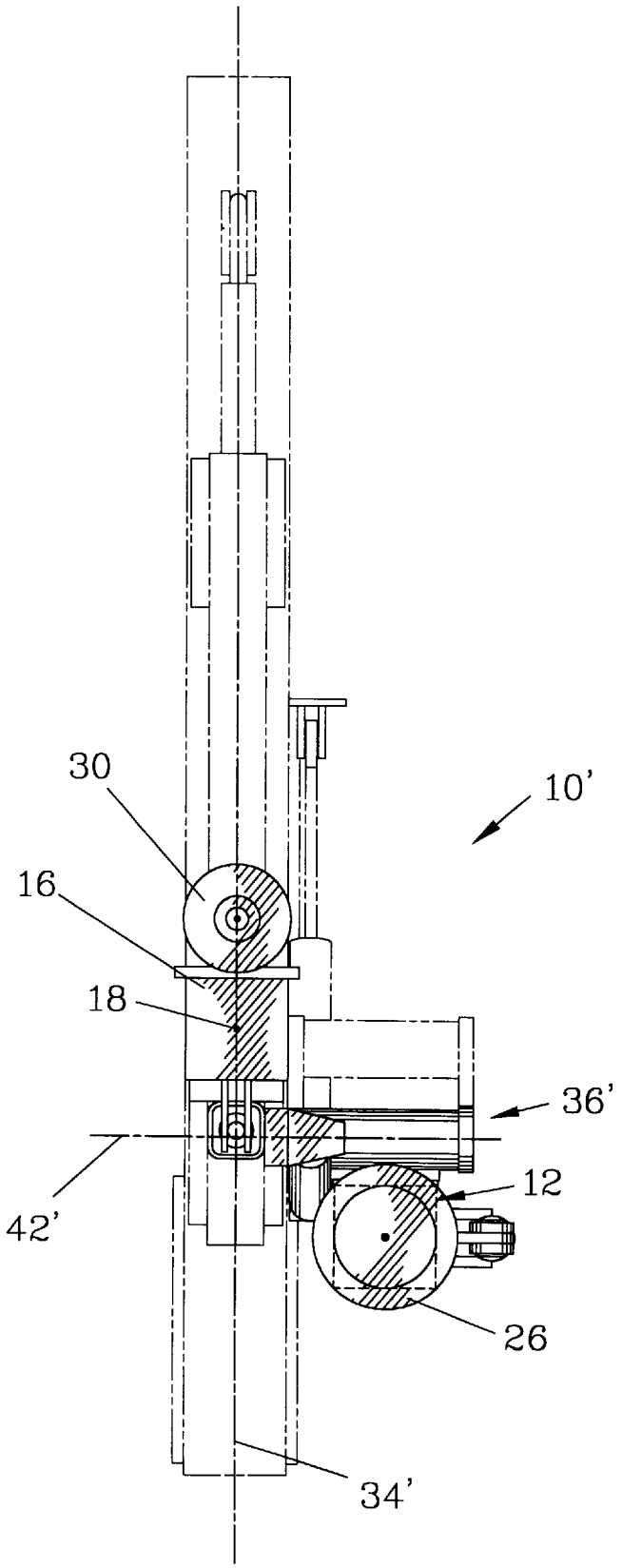
Prior Art Figure 5
FIG. 5 is an end view of an alternative prior art feed shell positioning mechanism which has a swivel axis which is perpendicular to the reference plane defined by the feed shell axis and the drill axis. The feed shell support is shown in a forward drilling orientation where the feed shell axis and drill axis are substantially parallel to the roll actuator axis.
Figure 6:
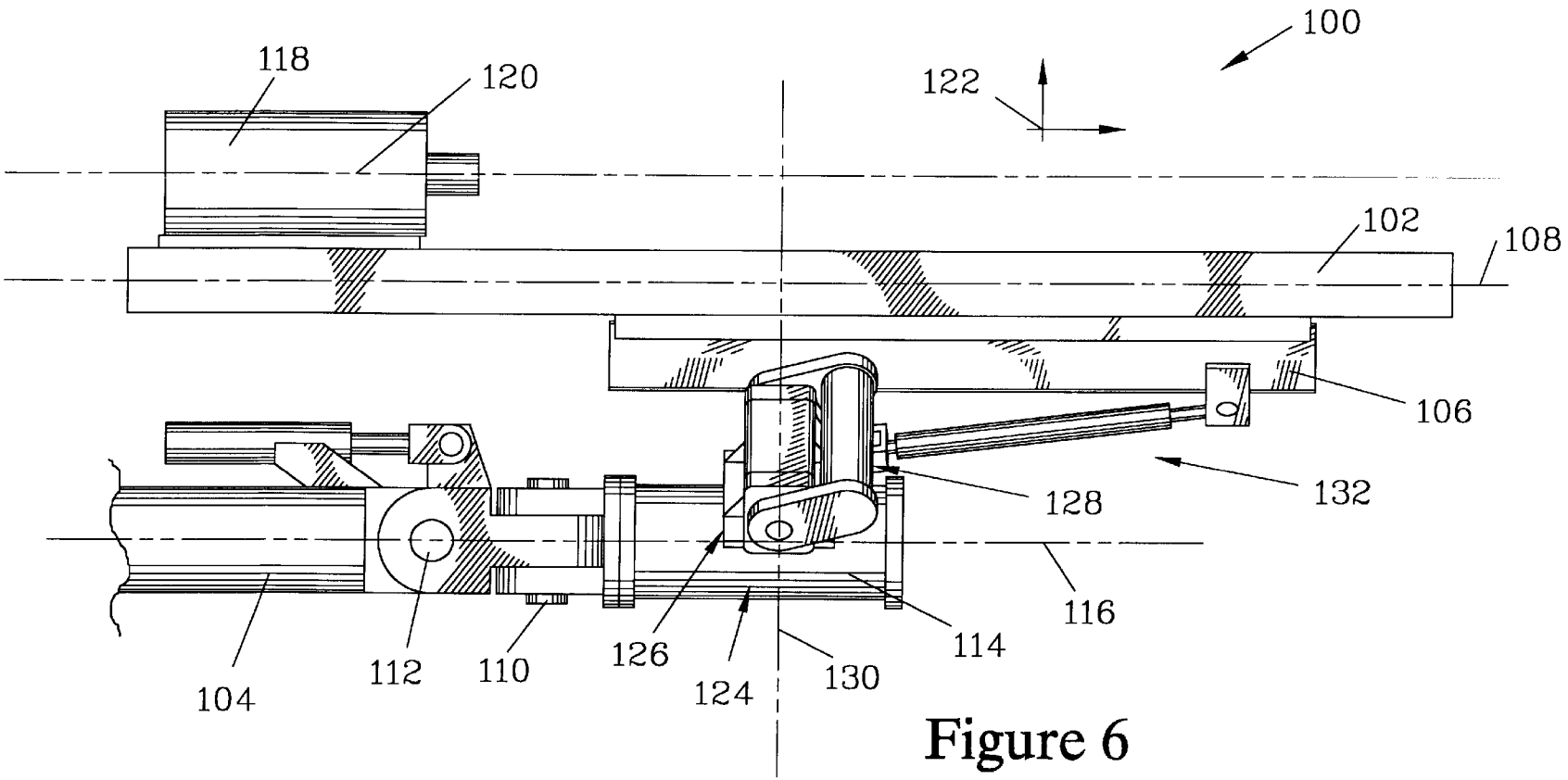
FIG. 6 is a side view of a feed shell positioning mechanism of one embodiment of the present invention. The feed shell positioning mechanism has a boom, a feed shell support, a feed shell having a feed shell axis, a roll actuator which rotates about a roll actuator axis, and a rock drill having a drill axis, where the feed shell axis and the drill axis define a reference plane. The feed shell positioning mechanism has a swivel assembly connecting between the roll actuator and the feed shell support. The feed shell support is shown in a forward drilling orientation, where the feed shell axis is substantially horizontal. The swivel assembly has a swivel axis which is inclined at 45° with respect to the reference plane and resides in a plane normal to the roll reference plane.
Figure 7:
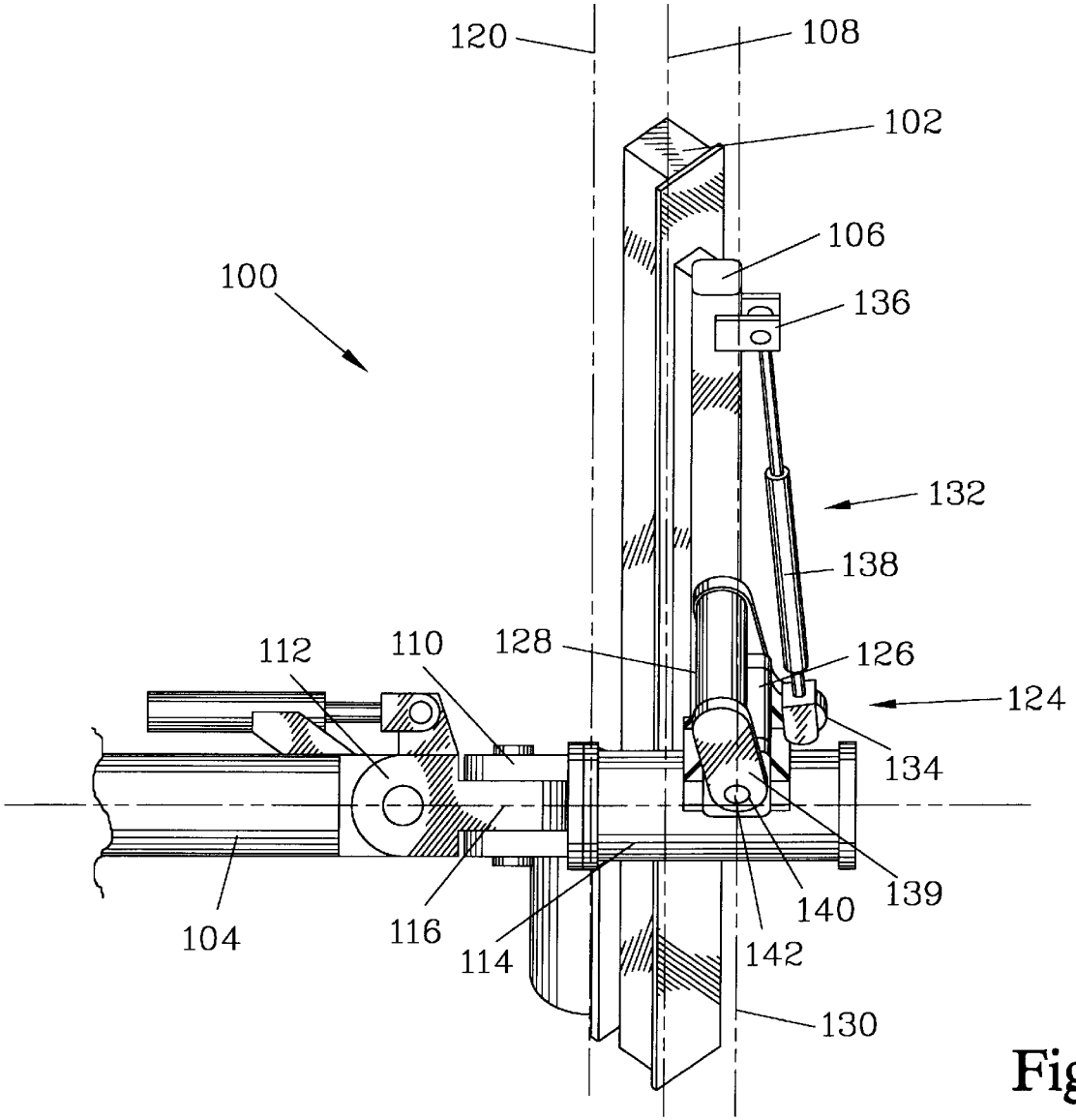
FIG. 7 is a side view of the feed shell positioning mechanism shown in FIG. 6, where the feed shell support has been pivoted from the forward drilling orientation illustrated in FIG. 6 to a sideways drilling orientation. In the sideways drilling orientation shown in FIG. 7, the feed shell axis is inclined at 45° with respect to a horizontal plane.
Figure 8:
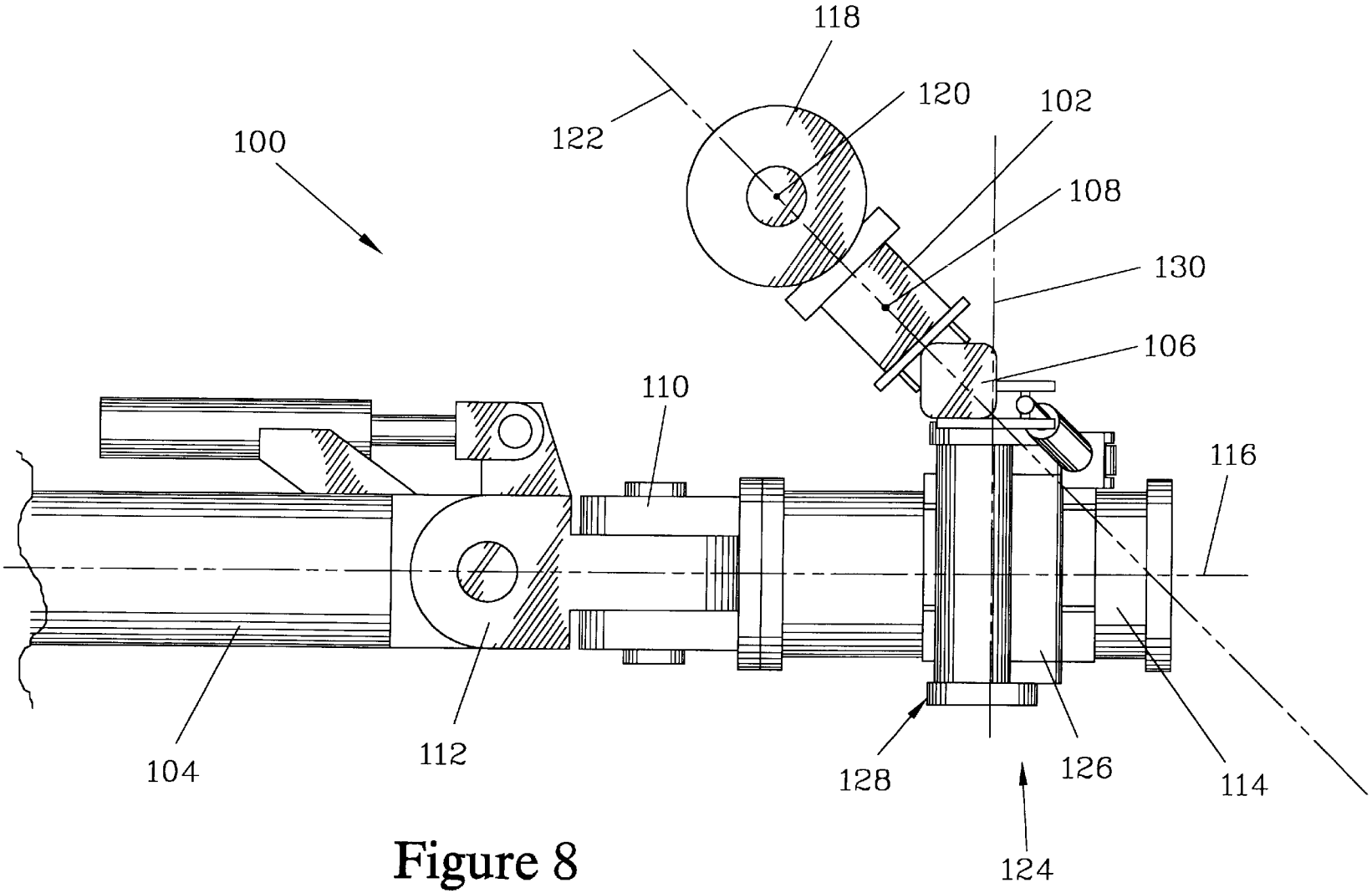
FIG. 8 is a side view of the feed shell positioning mechanism shown in FIGS. 6 and 7, where the roll actuator has been employed to roll the swivel assembly, feed shell support, and feed shell to a position where the feed shell axis is again substantially horizontal.
Figure 9:
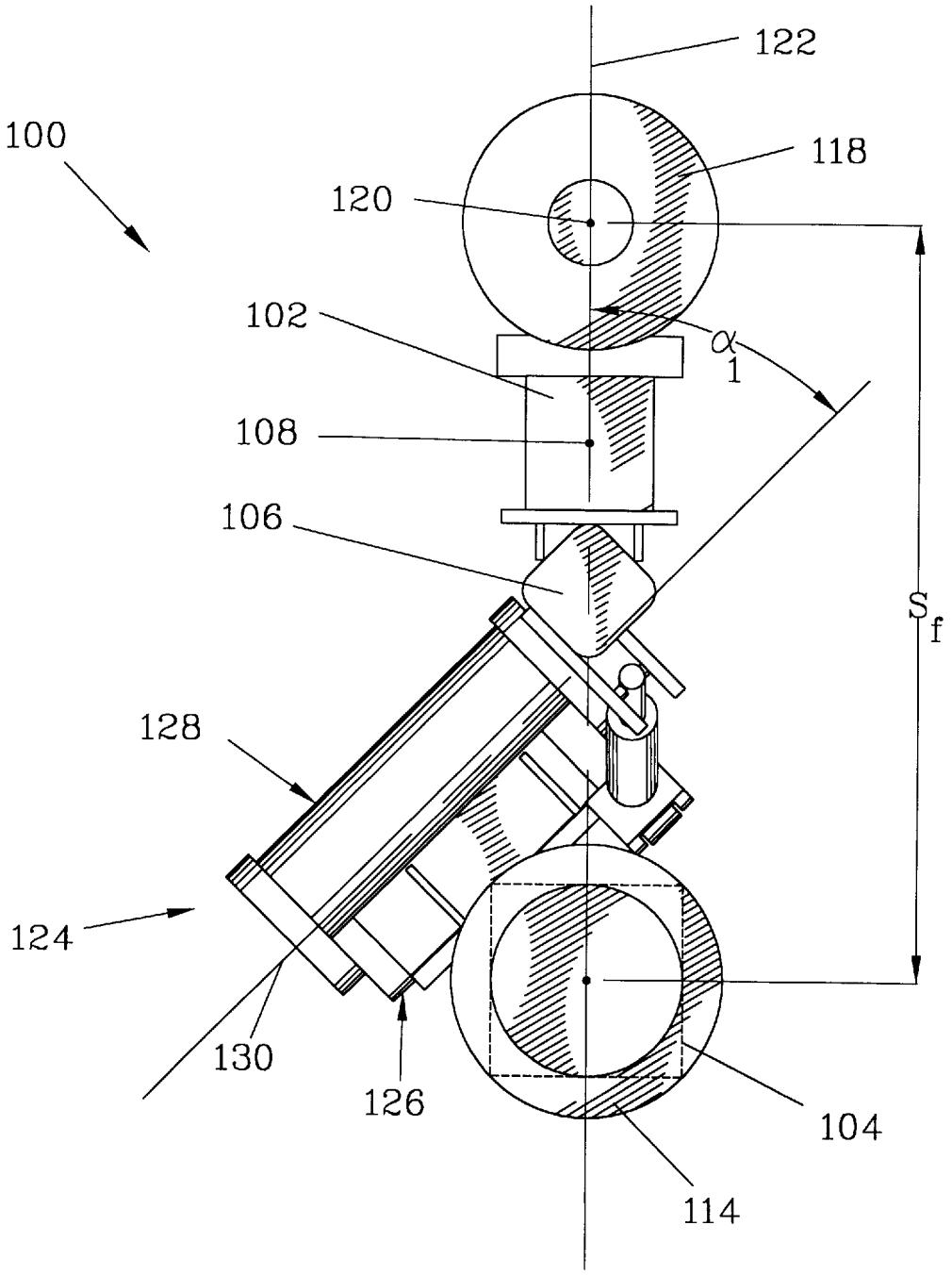
FIG. 9 is an end view of the feed shell positioning mechanism shown in FIG. 6, where the feed shell support is shown in the forward drilling orientation and the feed shell axis is substantially horizontal.
Figure 10:
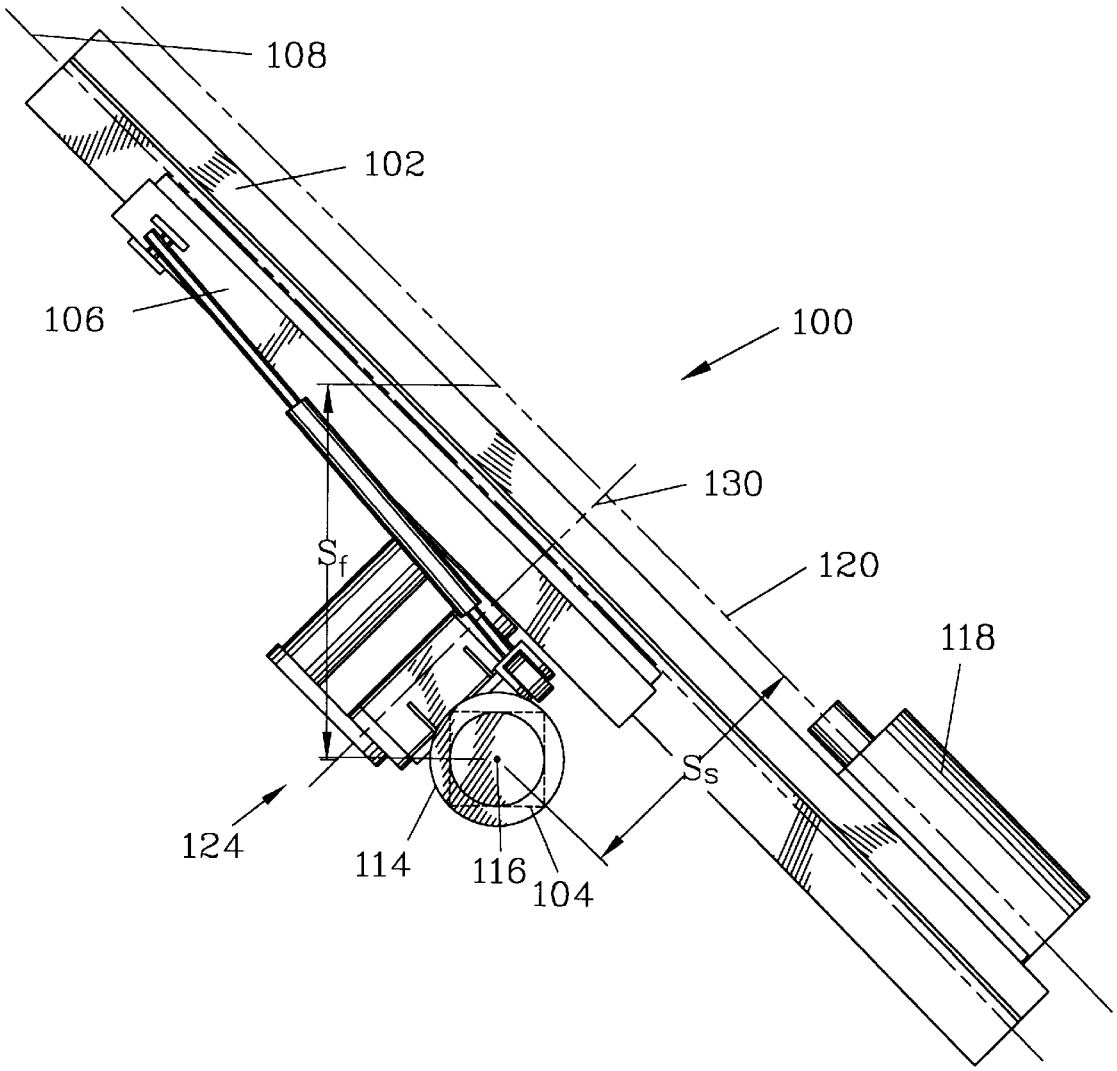
FIG. 10 is an end view of the feed shell positioning mechanism shown in FIG. 7, where the feed shell support has been pivoted to the sideways drilling orientation shown in FIG. 7 and the feed shell axis is inclined at 45°.
Figure 11:
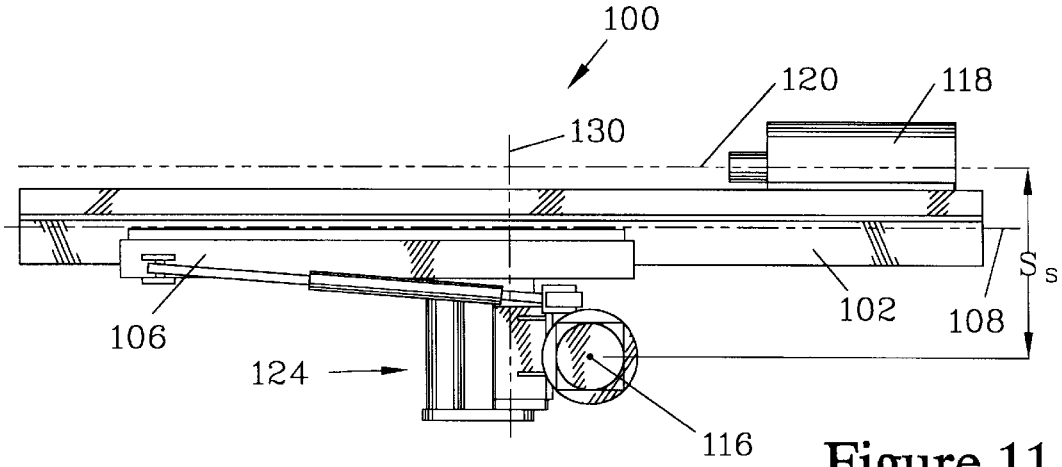
FIG. 11 is an end view of the feed shell positioning mechanism shown in FIG. 8, where the feed shell axis is substantially horizontal.

FIGS. 6 through 8 are a series of side views of a feed shell positioning mechanism 100 of one embodiment of the present invention illustrating a feed shell 102 in various positions with respect to a boom 104 to which it is mounted. FIGS. 9 through 11 are the corresponding end views for the feed shell positioning mechanism 100. The feed shell positioning mechanism 100 shares many features with the prior art feed shell positioning mechanism 10 shown in FIGS. 1 through 4. The feed shell positioning mechanism 100 employs the boom 104, and a feed shell support 106 is pivotably and rotatably mounted with respect to the boom 104. The feed shell 102 has a longitudinal feed shell axis 108 and slidably engages with the feed shell support 106. A means for advancing the feed shell 102 (not illustrated) is employed, such as a linear actuator, to advance the feed shell 102 along the feed shell support 106 in a direction parallel to the feed shell axis 108 toward the rock surface to be drilled.

In the feed shell positioning mechanism 100, a horizontal wrist joint 110 is provided to allow the feed shell 102 to be swivelled relative to the boom 104 in the horizontal plane. Similarly, a vertical wrist joint 112 is provided to allow the feed shell 102 to be swivelled relative to the boom 104 in the vertical plane.

The feed shell positioning mechanism 100 includes a roll actuator 114 which has a roll actuator axis 116 and is connected to the boom 104, having the wrist joints (110 and 112) interposed therebetween. The roll actuator 114 is interposed between the boom 104 and the feed shell support 106, and provides rotation of the feed shell support 106 about the roll actuator axis 116. A helical rotary actuator is well suited for providing the roll actuator 114 in the feed shell positioning mechanism 100.

A rock drill 118, which has a drill axis 120 which is parallel to the feed shell axis 108, is advancable along the feed shell 102. In combination, the feed shell axis 108 and the drill axis 120 define a reference plane 122. The wrist joints (110 and 112) assist in maintaining alignment of the holes drilled by the rock drill 118. The horizontal wrist joint 110 allows the rock drill 118 to be maintained in a vertical plane parallel to the axes of previously drilled holes as the boom 104 is swung in a horizontal plane, while the vertical wrist joint 112 allows the rock drill 118 to be maintained in a horizontal plane as the boom 104 is raised or lowered.

The improvement of the feed shell positioning mechanism 100 resides in a swivel assembly 124 which attaches to the feed shell support 106 and the roll actuator 114. The swivel assembly 124 has a roll actuator securing element 126, which is fixably attached to the roll actuator 114, and a feed shell support securing element 128, which is fixably attached to the feed shell support 106. The roll actuator securing element 126 and the feed shell support securing element 128 are pivotably connected and rotate about a swivel axis 130. The swivel axis 130 is substantially inclined with respect to the reference plane 122 by an angle $\alpha_1$. This inclination of the swivel axis 130 is best shown in FIG. 9, which is an end view of the feed shell positioning mechanism 100 shown in FIG. 6. In the embodiment illustrated, the angle $\alpha_1$ is 45° and the swivel axis 130 is normal to the roll actuator axis 116. The swivel axis 130 resides in a plane which is normal to the reference plane 122. In the orientation shown in FIGS. 6 and 9, the roll actuator axis 116 resides in the reference plane 122.

The swivel assembly 124 also includes swivel activating means 132 which pivots the feed shell support 106 with respect to the roll actuator 114 between a forward drilling orientation and a sideways drilling orientation. In the forward drilling orientation, which is illustrated in FIGS. 6 and 9, the feed shell axis 108 and the roll actuator axis 116 are in a substantially parallel relationship. In the sideways drilling orientation, which is illustrated in FIGS. 7, 8, 10, and 11, the feed shell axis 108 is substantially normal to the roll actuator axis 116.

As best shown in FIG. 7, the swivel activating means 132 in the feed shell positioning mechanism 100 has a roll actuator securing element arm 134. The roll actuator securing element arm 134 is fixably positioned with respect to the roll actuator securing element 126. A feed shell support bracket 136 is also provided, which is fixably attached to the feed shell support 106. A linear actuator 138 which is a hydraulic cylinder is pivotably connected between the roll actuator securing element arm 134 and the feed shell support bracket 136.

Still referring to FIG. 7, the roll actuator securing element 126 has a longitudinal passage therethrough (not shown). The roll actuator securing element 126 is configured to maintain the longitudinal passage inclined with respect to the reference plane 122 defined by the feed shell axis 108 and the drill axis 120.

The feed shell support securing element 128 of the swivel assembly 124, which is attached to the feed shell support 106, has pivot arms 139, which have arm passages 140 therethrough. A pivot shaft 142 passes through the arm passages 140 and the longitudinal passage of the roll actuator securing element 126. The pivot shaft 142 has a longitudinal axis which is coincident with the swivel axis 130.

FIGS. 6 through 8 illustrate how the feed shell 102 pivots from the forward drilling orientation (illustrated in FIG. 6) to the sideways drilling orientation where the feed shell axis 108 is inclined at 45° to a horizontal plane (illustrated in FIG. 7), and then is rolled to a position where the feed shell axis 108 is horizontal (illustrated in FIG. 8). FIGS. 9 through 11 show the respective corresponding end views. The forward drilling orientation is illustrated in FIG. 9. The sideways drilling orientation is illustrated in FIG. 10. FIG. 11 illustrates the sideways drilling orientation of FIG. 10 after the feed shell axis 108 has been rotated to a horizontal position.

An appreciation of the action of the feed shell positioning mechanism 100, and how the separation between the roll actuator axis 116 and the drill axis 120 varies can be obtained by a systematic review of FIGS. 6 through 11.

FIGS. 6 and 9 show the feed shell positioning mechanism 100 where the roll actuator 114 is positioned such that the feed shell 102 is disposed directly above the boom 104 and the feed shell axis 108 is substantially horizontal. When the feed shell is so positioned, the separation between the roll actuator axis 116 and the drill axis 120 is maximized. When the feed shell support 106 is pivoted to the sideways drilling orientation, as shown in FIGS. 7 and 10, the feed shell axis 108 is inclined at 45° with respect to a horizontal plane, and the separation between the roll actuator axis 116 and the drill axis 120 has been reduced; however, the feed shell 102 is inclined with respect to a horizontal plane. To bring the feed shell axis 108 to the horizontal plane position, as shown in FIGS. 8 and 11, the roll actuator 114 is activated and rotates the swivel assembly 124, the feed shell support 106, and the feed shell 102 about the roll actuator axis 116 until the feed shell 102 becomes horizontal. This action of the feed shell positioning mechanism 100 is different from the action of the feed shell positioning mechanism 10 illustrated in FIGS. 1 through 4, in which the feed shell axis 18 remains horizontal throughout the pivoting operation; however, the swivel assembly 124 of the present invention provides variable separation between the roll actuator axis 116 and the drill axis 120 without offsetting, which is not provided by prior art swivel assemblies such as the swivel assembly 24 discussed in the background of the invention.

A comparison of the end views of FIGS. 9, 10 and 11, reveals that the separation between the roll actuator axis 116 and the drill axis 120 decreases when the feed shell support 106 is swivelled normal to the roll actuator axis 116. In the forward drilling orientation as shown in FIG. 9, the drill axis 120 is separated from the roll actuator axis 116 by a forward separation $S_f$. The forward separation $S_f$ has been selected to be relatively large, providing a sufficient separation between the feed shell 102 and the-boom 104. In the forward drilling orientation, the large value for the forward separation $S_f$ is advantageous, since it allows greater movement of the vertical wrist joint 112 without interference of the feed shell 102 with the boom 104. Furthermore, a large forward separation $S_f$ is not objectionable in the forward position, since stresses resulting from drilling operations are in line with the boom 104 and can be readily accommodated by the boom 104 and the swivel assembly 124.

When the feed shell support 106 is pivoted to the sideways drilling orientation as shown in FIGS. 10 and 11, the drill axis 120 is separated from the roll actuator axis 116 by a sideways separation $S_s$ which is less than $S_f$. The difference between the sideways separation $S_s$ and the forward separation $S_f$ is best shown in FIG. 10. The sideways separation $S_s$ defines the moment of forces imparted by the rock drill 118 on the boom 104 and on the associated elements connected between the boom 104 and the rock drill 118. In the sideways drilling orientation, the reduced sideways separation $S_s$ results in reduced moment for forces acting on the boom 104 and associated elements when the rock drill 118 is employed for drilling operations. The reduction of moment reduces torsional loads on the boom 104 and associated structure and allows the boom 104 and associated elements to be lighter and more compact.

In the feed shell positioning mechanism 100 illustrated, the feed shell 102 and rock drill 118 are positioned such that the roll actuator axis 116 resides in the reference plane 122 when the feed shell support 106 is in the forward drilling orientation, and the swivel axis 130 is normal to the roll actuator axis 116. For this particular geometry, the ratio of the sideways separation $S_s$ to the forward separation $S_f$ is equal to the cosine of the angle $\alpha_1$. Since the angle $\alpha_1$ in this embodiment is 45°, the ratio of the sideways separation $S_s$ to the forward separation $S_f$ is 0.707. This results in a 29.3% reduction in the moment arm in the sideways drilling orientation. Additionally, using 45° for the angle $\alpha_1$ typically provides sufficient clearance for accommodating pivoting the feed shell 102 without interfering with the boom 104.

It will also be noted that, in the feed shell positioning mechanism 100 illustrated, the projection of the swivel axis 130 on the reference plane 122 is positioned normal to the feed shell axis 108 and the drill axis 120. This geometry simplifies the fabrication of the feed shell positioning mechanism 100.

While the angle $\alpha_1$ in the embodiment illustrated in FIGS. 6 through 11 measures 45°, other values for the angle $\alpha$ can be employed. As the angle $\alpha$ is increased between 0 and 90 degrees, the value of the cosine of angle $\alpha$ decreases, corresponding to a decrease in the sideways separation $S_s$, and a resultant decrease in the torque on the boom 104; however, there will be a practical maximum value for angle $\alpha$, which will be defined by the geometry of the feed shell positioning mechanism 100. At some point, attempts to further increase the angle $\alpha$ will result in the boom 104 interfering with pivoting the feed shell 102. It will be noted that in the prior art feed shell positioning mechanism 10', where the swivel axis is normal to the reference plane, the reference plane must be offset with respect to the boom to prevent interference between the boom and the feed shell when the feed shell support is pivoted. Additionally, while the swivel axis 130 of the embodiment shown in FIGS. 6 through 11 is normal to the roll actuator axis 116, in other embodiments the swivel axis may be inclined with respect to the roll actuator axis.

Figure 12:
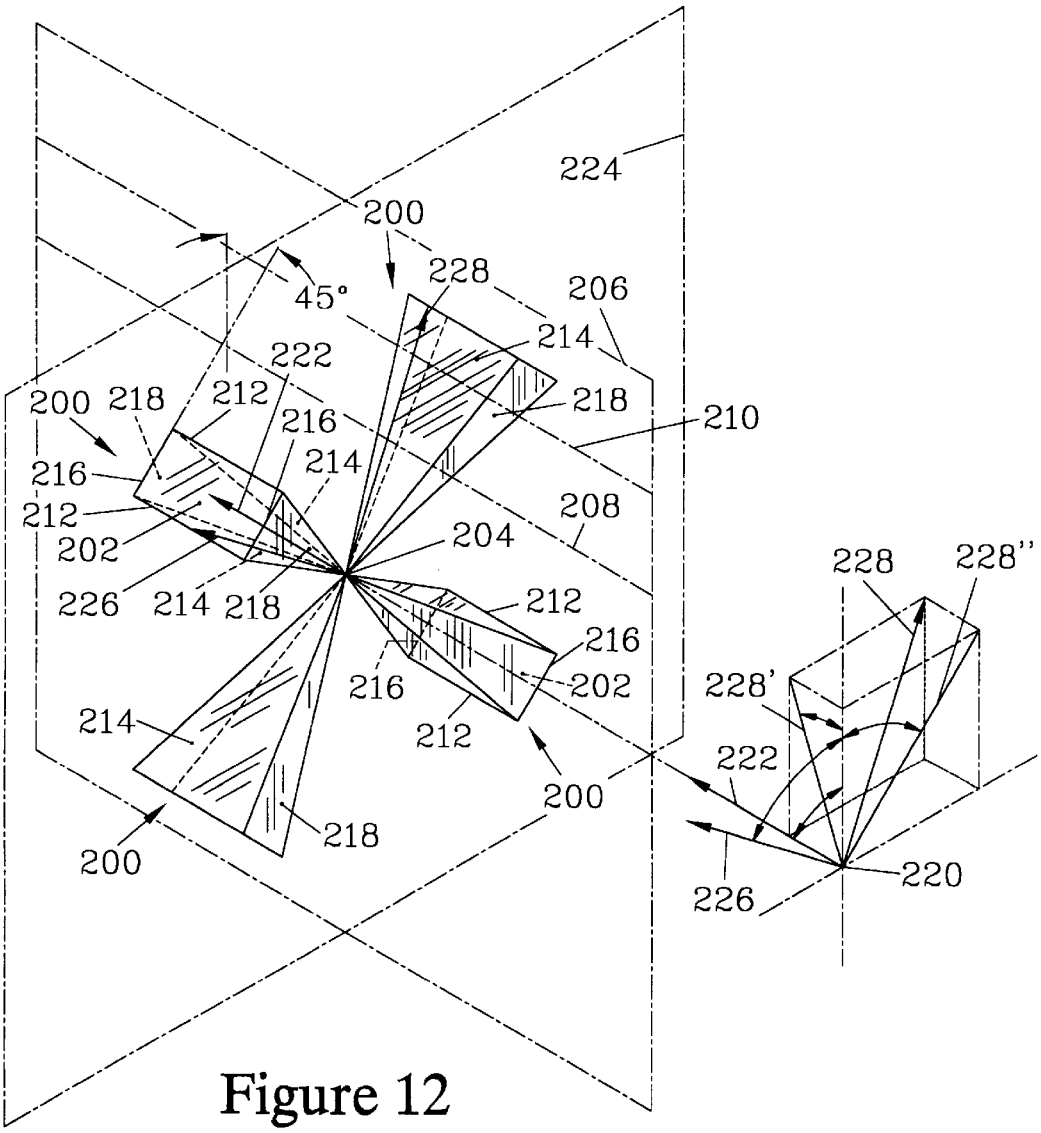
FIG. 12 is an isometric view which illustrates a preferred range of angles for the swivel axis for the present invention, with reference to a reference plane having a drill axis, a feed shell axis, and a roll actuator axis, these axes being depicted when the drill axis is in the forward drilling orientation.

FIG. 12 is an isometric view which illustrates a preferred range of angles for the swivel axis with respect to a reference plane. When the swivel axis is maintained within the range of angles illustrated in FIG. 12, the forward separation $S_f$ between the drill axis and the roll actuator axis is substantially greater than the sideways separation $S_s$. The preferred range of angles are those directions defined with respect to four pyramids 200, each having a rectangular base 202. The relationship of the swivel axis to the pyramids 200 is such that the swivel axis is parallel to a ray passing through one of the rectangular bases 202 and through an apex 204 which is a common vertex of the pyramids 200 and is spaced apart from the rectangular bases 202. The apex 204 resides in a reference plane 206, defined by a feed shell axis 208 and a drill axis 210.

The rectangular base 202 of each of the pyramids 200 has a pair of long base edges 212 which form bases for a first pair of isosceles triangular sides 214 of the pyramid 200. The first pair of isosceles triangular sides 214 are inclined to each other by an angle of 30° and meet at the apex 204. The rectangular base 202 also has a pair of short base edges 216 which form bases for a second pair of isosceles triangular sides 218 of the pyramid 200. The second pair of isosceles triangular sides 218 are inclined to each other by an angle of 60° and meet at the apex 204.

The spacial relationship of the pyramids 200 in relation to the reference plane 206 is further defined in that the pyramids 200 are arranged about the apex 204 in two pairs of opposed pyramids 200, the two pairs of opposed pyramids 200 being mirror images of each other with respect to the reference plane 206. The pyramids 200 are situated such that the rectangular bases 202 are each positioned at a 45° angle with respect to the reference plane 206, with the pair of long base edges 212 being parallel to the reference plane 206.

Figure 13:
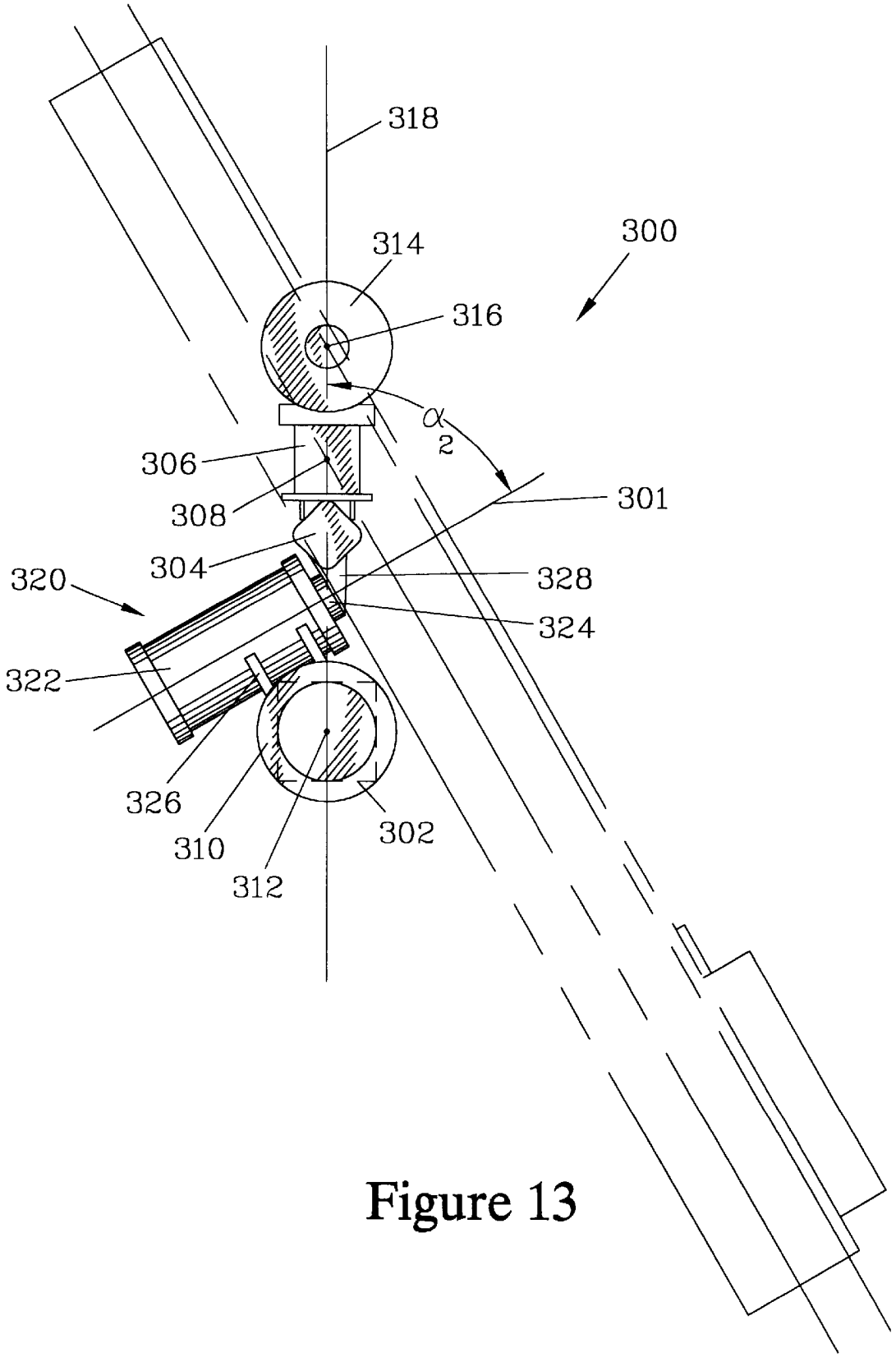
FIG. 13 is an end view of an alternative embodiment of the present invention. The embodiment shown in FIG. 13 employs a swivel rotary actuator which is mounted between the roll actuator and the feed shell support to pivot the feed shell support between a forward drilling orientation shown and a sideways drilling orientation shown in phantom. For this embodiment, the swivel rotary actuator has a rotary actuator axis which provides the swivel axis and, for the embodiment illustrated, the swivel axis is inclined at 600 with respect to the reference plane and resides in a plane which is normal to the reference plane.

FIG. 12 corresponds to a view looking forward away from the boom from a reference point 220, which corresponds approximately to the viewpoint of the operator. The inclination of the swivel axis 130 of the embodiment shown in FIGS. 6 through 11 is represented as a ray 222 which lies within one of the pyramids 200. As can be seen in FIGS. 6 through 11, the swivel axis 130 makes a 45° angle with the reference plane 206 and resides in a normal plane 224 which is normal to the reference plane 206. The ray 222 which corresponds to the inclination of the swivel axis 130 extends from the apex 204 to the center of one of the rectangular bases 202. A ray 226, which represents the inclination of a swivel axis 301 for the embodiment illustrated in FIG. 13, is also shown in FIG. 12, as is a ray 228 which represents the inclination of a swivel axis 401 for the embodiment illustrated in FIGS. 14 and 15. These embodiments are discussed in greater detail below. These three rays (222, 226, and 228) are also illustrated relative to a set of axes displaced from the pyramids 200 to more clearly show their orientations.

The ray 226, which represents the swivel axis 301 of the embodiment shown in FIG. 13 resides in the normal plane 224, and passes through the rectangular base 202 and apex 204 of one of the pyramids 200 defined in FIG. 12. However, while the ray 226 remains in the normal plane 224, the angle of inclination between ray 226 and the reference plane 206 has been increased to 60° as compared to 45° for the ray 222 which corresponds to the swivel axis 130 provided in the embodiment shown in FIGS. 6 through 11. The ray 226 representing the swivel axis 301 extends from the apex 204 to the center of one of the long base edges 212.

FIG. 13 is an end view of a feed shell positioning mechanism 300 of an embodiment of the present invention which employs the swivel axis 301 which has the inclination represented by the ray 226 illustrated in FIG. 12. The feed shell positioning mechanism 300 shares many features with the feed shell positioning mechanism 100 shown in FIGS. 6 through 11. The feed shell positioning mechanism 300 employs a boom 302, which supports a feed shell support 304, on which is slidably mounted a feed shell 306 having a longitudinal feed shell axis 308. The feed shell positioning mechanism 300 also includes a roll actuator 310 which is mounted on the boom 302 to provide a means of rotation about a roll actuator axis 312. The roll actuator 310 is preferably a helical rotary actuator. A rock drill 314 is advancable along the feed shell 306 and has a drill axis 316 which is parallel to the feed shell axis 308. The feed shell axis 308 and the drill axis 316 define a reference plane 318.

The feed shell positioning mechanism 300 also includes a swivel rotary actuator 320 having a housing 322 and an output shaft 324. The swivel rotary actuator 320 attaches between a roll actuator securing element 326, which is affixed to the roll actuator 310, and a feed shell support securing element 328, which is affixed to the feed shell support 304. The swivel rotary actuator 320 provides swivel activating means. In the embodiment illustrated, the housing 322 is affixed to the roll actuator securing element 326, and the output shaft 324 is affixed to the feed shell support securing element 328. Alternatively, the housing 322 could be affixed to the feed shell support securing element 328, in which case the output shaft 324 is affixed to the roll actuator securing element 326.

The swivel rotary actuator 320 is activatable to provide rotation between the housing 322 and the output shaft 324 about the swivel axis 301 of the swivel rotary actuator 320. The swivel rotary actuator 320 serves to pivot the feed shell support 304 about the swivel axis 301 between a forward drilling orientation, as illustrated, and a sideways drilling orientation, which is shown in phantom. The housing 322 of the swivel rotary actuator 320 is mounted to the roll actuator 310 such that the swivel axis 301 is inclined with respect to the reference plane 318 by an angle $\alpha_2$. In the embodiment illustrated, the angle $\alpha_2$ measures 60°. With the increase in angle, the reduction in the moment arm in the sideways drilling orientation is increased to 50%. However, this increased reduction in the moment arm is obtained in part by requiring greater clearance above the boom 302 to allow for swivelling the feed support 304. The swivel rotary actuator 320 illustrated is preferably a helical rotary actuator, such as the Helac® helical rotary actuator.

While employing a swivel rotary actuator as the swivel assembly simplifies the structure of the feed shell positioning mechanism 300, such rotary actuators typically have an undesirable amount of free play. Additionally, such rotary actuators are generally bulkier and more expensive to employ than a swivel assembly such as the swivel assembly 124 illustrated in FIGS. 6 through 11, which employs the linear actuator 138 for the swivel activating means.

Figure 15:
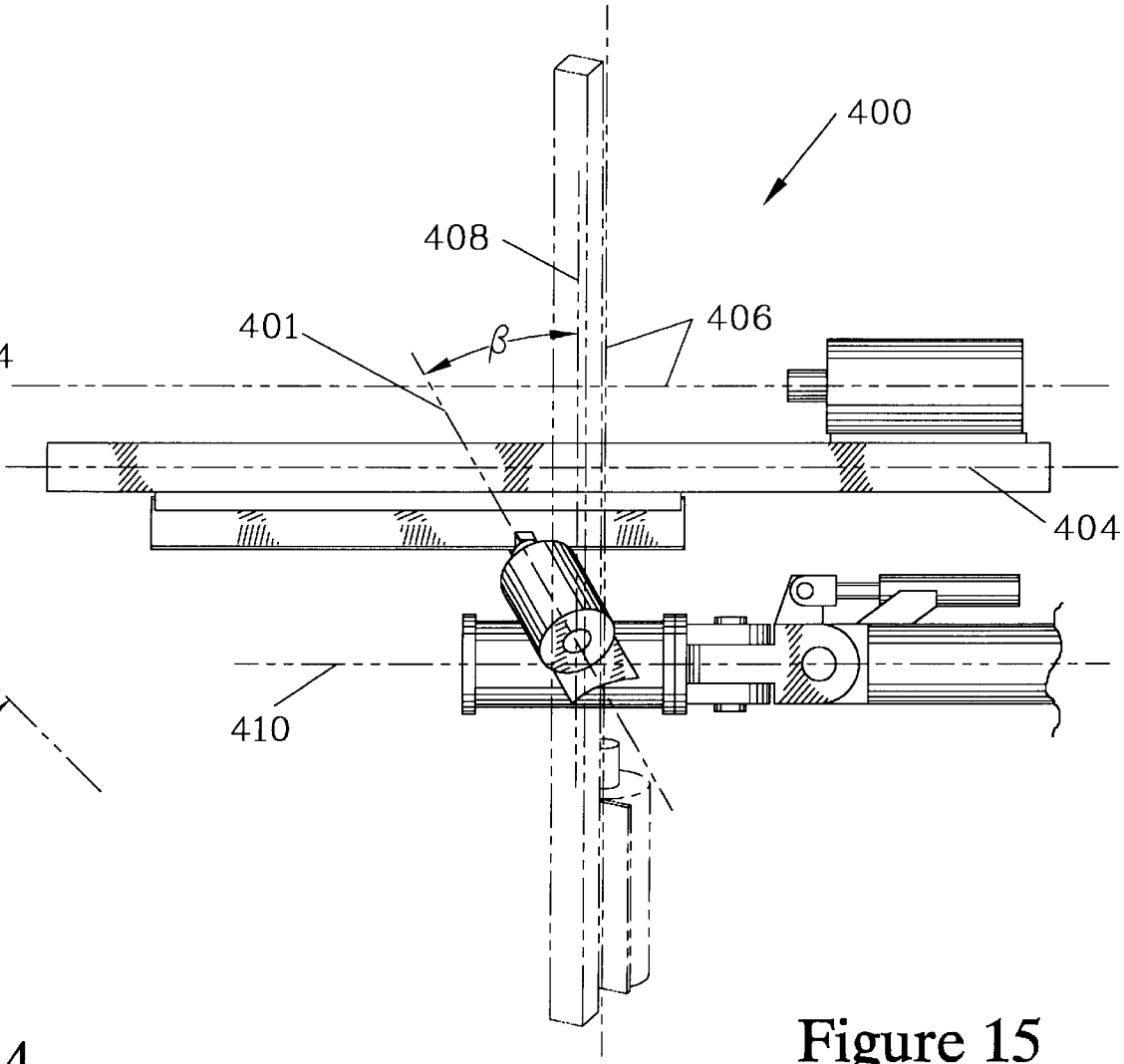
FIG. 15 is a side view of the embodiment shown in FIG. 14. Again, the feed shell support is shown in the forward drilling orientation, and the sideways drilling orientation is shown in phantom.
Figure 14:
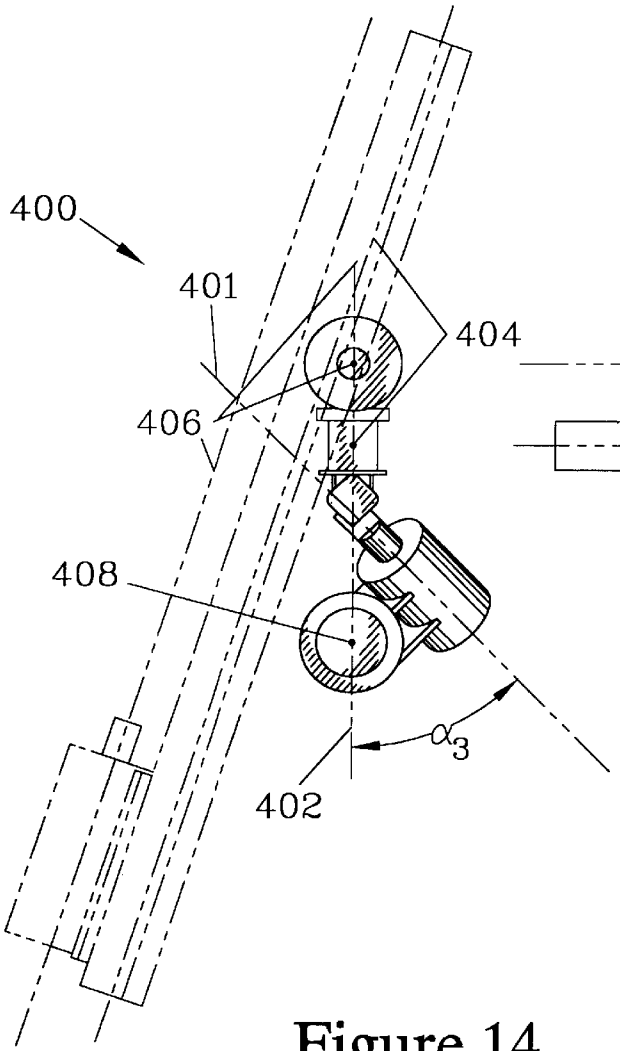
FIG. 14 is an end view of a feed shell positioning mechanism where the swivel axis is inclined with respect to both the reference plane and a plane normal to the reference plane. The feed shell support is shown in a forward drilling orientation.

FIGS. 14 and 15 illustrate a feed shell positioning mechanism 400 which has the swivel axis 401 which has the inclination of the ray 228 illustrated in FIG. 12. The swivel axis 401 is inclined both to a reference plane 402 defined by a feed shell axis 404 and a drill axis 406, and is also inclined with respect to a normal plane 408 which is normal to the reference plane 402. As shown in the side view of FIG. 15, the swivel axis 401 is inclined to the normal plane 408, rather than residing in the normal plane as in the previously described embodiments. The inclination of the swivel axis 401 is such that the projection of the swivel axis 401 onto the reference plane 402 is inclined to the normal plane 408 by an angle β which measures 30°. As shown in FIG. 14, the swivel axis 401 is also inclined such that the projection of the swivel axis 401 onto the normal plane 408 is inclined to the reference plane 402 by an angle $\alpha_3$ which measures 45°.

Referring again to FIG. 12, the ray 228 which defines the orientation of the swivel axis 401 passes through the rectangular base 202 and apex 204 of one of the pyramids 200 defined in FIG. 12. The ray 228 does not reside in the normal plane 224, but rather is inclined with respect to the normal plane 224 such that the projection 228' of the ray 228 onto the reference plane 206 is inclined to the normal plane 408 by an angle of 30°. The ray 228 is also inclined with respect to the reference plane 206 such that the projection 228" of the ray 228 onto the normal plane 224 is inclined 45° to the reference plane 206. The actual angle of the ray 228 with respect to the reference plane 206 is defined by the combined vectors of these two angles. The ray 228 extends from the apex 204 to the center of one of the short base edges 216.

FIGS. 14 and 15 show the feed shell positioning mechanism when the feed shell axis 404 and the drill axis 406 are in a forward drilling orientation, where they are substantially parallel to a roll actuator axis 410. FIGS. 14 and 15 also show, in phantom, when the feed shell axis 404 and the drill axis 406 have been rotated about the swivel axis 401 to a sideways drilling orientation, where they are normal to the roll actuator axis 408. Unlike the embodiments illustrated previously, where a rotation of 90° is required to move the feed shell between the forward and sideways drilling orientations, the inclination of the swivel axis 401 with respect to the roll actuator axis 408 requires that the feed shell axis 404 and drill axis 406 be rotated further. In the feed shell positioning mechanism 400, a rotation of 99¼° is required to move the feed shell to the sideways drilling orientation shown.

While the inclination of the swivel axis 401 with respect to the normal plane 408 requires further rotation, it achieves a further decrease in the moment arm of the drill in the sideways drilling orientation. In the embodiment shown, where the angle β is 30° and the angle $\alpha_3$ measures 45°, the reduction in the separation between the drill axis 406 and the roll actuator axis 408 is 33.8%. This is greater than the 29.3% reduction achieved in the embodiment shown in FIGS. 6 through 11, where the swivel axis 130 resides in a plane normal to the reference plane 122 and is inclined 45° with respect to the reference plane 122.

While the novel features of the present invention have been described in terms of particular embodiments and preferred applications, it should be appreciated by one skilled in the art that substitution of materials and modification of details obviously can be made without departing from the spirit of the invention.

What I claim is:

1. An improved feed shell positioning mechanism for a rock drilling machine, the feed shell positioning mechanism having, a boom, a feed shell support pivotably and rotatably mounted with respect to the boom, a feed shell having a feed shell axis, the feed shell being slidably engaged with the feed shell support, means for advancing the feed shell along the feed shell support, a roll actuator having a roll actuator axis, the roll actuator being interposed between the boom and the feed shell support to provide rotational motion between the feed shell support and the boom about the roll actuator axis, and a rock drill having a drill axis which is parallel to the feed shell axis, the rock drill being advancable along the feed shell, the feed shell axis and the drill axis defining a reference plane, the improvement residing in a swivel assembly attaching the feed shell support to the roll actuator, the swivel assembly comprising:

a roll actuator securing element fixably positioned with respect to the roll actuator;

a feed shell support securing element fixably positioned with respect to the feed shell support, said roll actuator securing element and said feed shell support securing element being mounted with respect to each other about a swivel axis which is inclined with respect to the reference plane, providing pivotal motion between the roll actuator and the feed shell support; and swivel activating means for pivoting the feed shell support with respect to the roll actuator about said inclined swivel axis between a forward drilling orientation and a sideways drilling orientation.

2. The improved feed shell positioning mechanism of claim 1 wherein said feed shell support securing element is pivotably mounted with respect to said roll actuator securing element, and further wherein said swivel activating means further comprise:

a linear actuator pivotably mounted with respect to the roll actuator and with respect to the feed shell support.

3. The improved feed shell positioning mechanism of claim 2 wherein said inclination of said swivel axis is restricted such that said swivel axis is parallel to a ray which radiates from an apex of a pyramid spaced apart from a rectangular base of said pyramid, through which said ray also passes, said rectangular base having, a pair of long base edges forming bases for a first pair of isosceles triangular sides of said pyramid that are inclined to each other by an angle of 30 degrees and meet at said apex, and a pair of short base edges forming bases for a second pair of isosceles triangular sides of said pyramid that are inclined to each other by an angle of 60 degrees and meet at said apex, and further wherein said rectangular base is positioned so as to make a 45 degree angle with respect to the reference plane, with said long base edges being parallel to the reference plane.

4. The improved feed shell positioning mechanism of claim 3 wherein said swivel axis is normal to the roll actuator axis.

5. The improved feed shell positioning mechanism of claim 1 wherein said swivel assembly further comprises:

a swivel rotary actuator having a housing and an output shaft which rotate with respect to each other about a common axis which serves as said swivel axis, said swivel rotary actuator being interposed between and connected to said roll actuator securing element and said feed shell support securing element, said swivel rotary actuator providing said swivel activating means.

6. The improved feed shell positioning mechanism of claim 5 wherein said housing is affixed to said roll actuator securing element and said output shaft is affixed to said feed shell support securing element.

7. The improved feed shell positioning mechanism of claim 6 wherein said inclination of said swivel axis is restricted such that said swivel axis is parallel to a ray which radiates from an apex of a pyramid spaced apart from a rectangular base of said pyramid, through which said ray passes, said rectangular base having, a pair of long base edges forming bases for a first pair of isosceles triangular sides of said pyramid that are inclined to each other by an angle of 30 degrees and meet at said apex, and a pair of short base edges forming bases for a second pair of isosceles triangular sides of said pyramid that are inclined to each other by an angle of 60 degrees and meet at said apex, and further wherein said rectangular base is positioned so as to make a 45 degree angle with respect to the reference plane, with said long base edges being parallel to the reference plane.

8. The improved feed shell positioning mechanism of claim 7 wherein said swivel axis is normal to the roll actuator axis.

9. An improved feed shell positioning mechanism for a rock drilling machine, the feed shell positioning mechanism having, a boom, a wrist assembly on the boom, the wrist assembly providing swivelling motion in two planes which are substantially normal, a feed shell support pivotably and rotatably mounted with respect to the wrist assembly, a feed shell having a feed shell axis, the feed shell being slidably engaged with the feed shell support, means for advancing the feed shell along the feed shell support, a roll actuator having a roll actuator axis, the roll actuator being interposed between the wrist assembly and the feed shell support to provide rotational motion between feed shell support and the boom about the roll actuator axis, and a rock drill having a drill axis which is parallel to the feed shell axis, the rock drill being advancable along the feed shell, the feed shell axis and the drill axis defining a reference plane, the improvement residing in a swivel assembly attaching the feed shell support to the roll actuator, the swivel assembly comprising:

a roll actuator securing element fixably positioned with respect to the roll actuator;

a feed shell support securing element fixably positioned with respect to the feed shell support, said roll actuator securing element and said feed shell support securing element being mounted with respect to each other about a swivel axis which is inclined with respect to the reference plane, providing pivotal motion between the roll actuator and the feed shell support; and swivel activating means for pivoting the feed shell support with respect to the roll actuator about said inclined swivel axis between a forward drilling orientation and a sideways drilling orientation.

10. The improved feed shell positioning mechanism of claim 9 wherein said feed shell support securing element is pivotably mounted with respect to said roll actuator securing element, and further wherein said swivel activating means further comprise:

a linear actuator pivotably mounted with respect to the roll actuator and with respect to the feed shell support.

11. The improved feed shell positioning mechanism of claim 10 wherein said inclination of said swivel axis is restricted such that said swivel axis is parallel to a ray which radiates from an apex of a pyramid spaced apart from a rectangular base of said pyramid, through which said ray passes, said rectangular base having, a pair of long base edges forming bases for a first pair of isosceles triangular sides of said pyramid that are inclined to each other by an angle of 30 degrees and meet at said apex, and a pair of short base edges forming bases for a second pair of isosceles triangular sides of said pyramid that are inclined to each other by an angle of 60 degrees and meet at said apex, and further wherein said rectangular base is positioned so as to make a 45 degree angle with respect to the reference plane, with said long base edges being parallel to the reference plane.

12. The improved feed shell positioning mechanism of claim 11 wherein said swivel axis is normal to the roll actuator axis.

13. The improved feed shell positioning mechanism of claim 9 wherein said swivel assembly further comprises:

a swivel rotary actuator having a housing and an output shaft which rotate with respect to each other about a common axis which serves as said swivel axis, said swivel rotary actuator being interposed between and connected to said roll actuator securing element and said feed shell support securing element, said swivel rotary actuator providing said swivel activating means.

14. The improved feed shell positioning mechanism of claim 13 wherein said housing is affixed to said roll actuator securing element and said output shaft is affixed to said feed shell support securing element.

15. The improved feed shell positioning mechanism of claim 14 wherein said inclination of said swivel axis is restricted such that said swivel axis is parallel to a ray which radiates from an apex of a pyramid spaced apart from a rectangular base of said pyramid, through which said ray passes, said rectangular base having, a pair of long base edges forming bases for a first pair of isosceles triangular sides of said pyramid that are inclined to each other by an angle of 30 degrees and meet at said apex, and a pair of short base edges forming bases for a second pair of isosceles triangular sides of said pyramid that are inclined to each other by an angle of 60 degrees and meet at said apex, and further wherein said rectangular base is positioned so as to make a 45 degree angle with respect to the reference plane, with said long base edges being parallel to the reference plane.

16. The improved feed shell positioning mechanism of claim 15 wherein said swivel axis is normal to the roll actuator axis.

* * * * *